US010208714B2

(12) United States Patent
Nitta et al.

(10) Patent No.: US 10,208,714 B2
(45) Date of Patent: Feb. 19, 2019

(54) HEAT EXCHANGER UTILIZED AS AN EGR COOLER IN A GAS RECIRCULATION SYSTEM

(71) Applicant: MIKUTAY CORPORATION, Upland, CA (US)

(72) Inventors: Minoru Nitta, Upland, CA (US); Takeyoshi Nitta, Upland, CA (US)

(73) Assignee: MIKUTAY CORPORATION, Upland, CA (US)

( * ) Notice: Subject to any disclaimer, the term of this patent is extended or adjusted under 35 U.S.C. 154(b) by 233 days.

(21) Appl. No.: 15/087,877

(22) Filed: Mar. 31, 2016

(65) Prior Publication Data

US 2017/0284343 A1 Oct. 5, 2017

(51) Int. Cl.
*F28F 13/12* (2006.01)
*F28D 7/16* (2006.01)
(Continued)

(52) U.S. Cl.
CPC ..... *F02M 26/32* (2016.02); *F28D 1/06* (2013.01); *F28D 3/02* (2013.01); *F28D 3/04* (2013.01);
(Continued)

(58) Field of Classification Search
CPC . F28D 7/1615; F28D 3/02; F28D 3/04; F28D 1/06; F28D 7/16; F28D 7/0025;
(Continued)

(56) References Cited

U.S. PATENT DOCUMENTS 141,133 A 7/1873 Gee
265,279 A 10/1882 Pierce et al.
(Continued)

FOREIGN PATENT DOCUMENTS

DE 2249117 A1 4/1974
DE 3300929 A1 7/1984
(Continued)

OTHER PUBLICATIONS

Patent Cooperation Treaty, "International Search Report and Written Opinion of the International Searching Authority" International Application No. PCT/US2009/002432 of Mikutay Corporation; dated Jul. 30, 2009; 11 pages.
(Continued)

*Primary Examiner* — Jon T. Schermerhorn, Jr.
(74) *Attorney, Agent, or Firm* — Pillsbury Winthrop Shaw Pittman LLP

(57) ABSTRACT

A heat exchanger for exchanging heat between a first medium and a second medium has a body comprising a pair of header plates, a pair of distribution plates, and a pair of case body lateral panels. Input and output header plates have a plurality of orifices, with a flow path assembly extending between each input header plate orifice and the corresponding output header plate orifice. Each flow path assembly includes at least one chamber assembly, having a corresponding medium directing component, disposed between a pair of tubular segments. Input and output distribution plates have a plurality of orifices. A first medium inlet side tank engages with the input header, a first medium output side tank engages with the output header plate, a second medium inlet side tank engages with the input distribution plate, and a second medium output side tank engages with the output distribution plate.

8 Claims, 8 Drawing Sheets

(51) Int. Cl.

| | |
|---|---|
| ***F02M 26/32*** | (2016.01) |
| ***F28D 3/04*** | (2006.01) |
| ***F28F 13/08*** | (2006.01) |
| ***F28D 1/06*** | (2006.01) |
| ***F28D 3/02*** | (2006.01) |
| *F28F 9/22* | (2006.01) |

(52) U.S. Cl.
CPC ..... *F28D 7/16* (2013.01); *F28D 7/1615* (2013.01); *F28F 13/08* (2013.01); *F28F 9/22* (2013.01)

(58) Field of Classification Search
CPC ..... F28D 17/04; F28D 21/0003; F02M 26/32; F28F 13/08; F28F 9/22; F28F 2009/0297; F28F 2009/0285; F28F 9/001
See application file for complete search history.

(56) References Cited

U.S. PATENT DOCUMENTS

| | | | | |
|---|---|---|---|---|
| 709,006 | A | 9/1902 | Geurink | |
| 722,717 | A | 3/1903 | Kiefer | |
| 838,966 | A | 12/1906 | Drew | |
| 1,159,784 | A | 11/1915 | Migchelbrink | |
| 1,327,165 | A | 1/1920 | Merritt | |
| 1,336,225 | A | 4/1920 | Hardie | |
| 1,656,790 | A | 1/1928 | Heijkenskjoid | |
| 1,666,660 | A | 4/1928 | Makin | |
| 1,714,771 | A | 5/1929 | Fuchs | |
| 1,844,308 | A | 2/1932 | Armacoast | |
| 2,030,734 | A | 2/1936 | Baird | |
| 2,045,657 | A | 6/1936 | Karmazin | |
| 2,274,965 | A | 3/1942 | Kitto | |
| 2,709,128 | A | 5/1955 | Krause | |
| 2,752,127 | A | 6/1956 | Campe et al. | |
| 3,099,315 | A * | 7/1963 | Loehr | F28F 1/08 165/109.1 |
| 3,293,383 | A | 12/1966 | Halliday, Jr. | |
| 3,759,322 | A | 9/1973 | Nasser et al. | |
| 3,976,128 | A | 8/1976 | Patel | |
| 4,332,293 | A | 6/1982 | Hiramatsu | |
| 4,588,543 | A | 5/1986 | Huebner | |
| 4,871,017 | A | 10/1989 | Cesaroni | |
| 4,872,504 | A * | 10/1989 | Huebner | B29C 65/02 165/54 |
| 4,955,435 | A | 9/1990 | Shuster et al. | |
| 4,981,170 | A * | 1/1991 | Dierbeck | F28F 13/12 165/109.1 |
| 5,137,080 | A | 8/1992 | Haasch et al. | |
| 5,211,222 | A | 5/1993 | Shinmura | |
| 1,946,234 | A | 2/1994 | Price | |
| 5,505,252 | A | 4/1996 | Mano | |
| 5,505,257 | A | 4/1996 | Goetz, Jr. | |
| 5,538,077 | A | 7/1996 | So et al. | |
| 5,642,774 | A * | 7/1997 | Christenson | F28F 9/001 165/149 |
| 6,612,031 | B2 | 9/2003 | Rhodes | |
| 7,021,370 | B2 | 4/2006 | Papapanu et al. | |
| 7,604,689 | B2 * | 10/2009 | Siverklev | B01D 53/268 165/165 |
| 7,686,071 | B2 | 3/2010 | Silverstein | |
| 7,987,900 | B2 | 8/2011 | Nitta et al. | |
| 8,307,886 | B2 * | 11/2012 | Nitta | F28F 13/08 165/109.1 |
| 8,308,943 | B2 * | 11/2012 | Kanazawa | B01D 63/02 210/247 |
| 8,393,385 | B2 * | 3/2013 | Nitta | F28F 13/08 165/170 |
| 8,584,741 | B2 | 11/2013 | Nitta et al. | |
| 9,151,547 | B2 * | 10/2015 | Nitta | F28F 9/22 |
| 9,562,723 | B2 * | 2/2017 | Cho | F28F 9/0209 |
| 9,631,539 | B2 * | 4/2017 | Cho | F28F 9/02 |
| 2004/0079516 | A1 | 4/2004 | Leeson et al. | |
| 2005/0098307 | A1 * | 5/2005 | Goto | F28D 7/1615 165/146 |
| 2006/0278368 | A1 | 12/2006 | Dawson | |
| 2007/0034363 | A1 * | 2/2007 | Mitsumoto | B01J 8/067 165/159 |
| 2007/0131401 | A1 * | 6/2007 | Daly | B29C 65/1635 165/158 |
| 2007/0215330 | A1 | 9/2007 | Umetsu | |
| 2009/0260786 | A1 | 10/2009 | Palanchon | |
| 2010/0046934 | A1 | 2/2010 | Johnson et al. | |
| 2010/0224346 | A1 | 9/2010 | Rasmussen | |
| 2011/0030936 | A1 | 2/2011 | Nitta et al. | |
| 2013/0098590 | A1 | 4/2013 | Nitta et al. | |
| 2014/0041842 | A1 * | 2/2014 | Nitta | F28F 1/006 165/175 |
| 2014/0131022 | A1 * | 5/2014 | Nitta | F28F 1/426 165/177 |
| 2015/0027675 | A1 * | 1/2015 | Nitta | F28F 9/22 165/168 |

FOREIGN PATENT DOCUMENTS

| | | | |
|---|---|---|---|
| EP | 1824629 | B1 | 5/2011 |
| FR | 2898405 | A1 | 9/2007 |
| JP | S50-11257 | | 4/1975 |
| JP | S56-068795 | | 6/1981 |
| JP | 56154275 | | 11/1981 |
| JP | S58-154393 | | 10/1983 |
| JP | S61-175492 | | 8/1986 |
| JP | H10-306995 | A | 11/1998 |
| JP | 11287571 | A | 10/1999 |
| JP | 2006-336902 | A | 12/2006 |
| JP | 2008-523347 | | 7/2008 |
| JP | 2011-518309 | | 6/2011 |
| RU | 1814716 | A3 | 5/1993 |
| WO | 03/056267 | A1 | 7/2003 |
| WO | 2007/101817 | A1 | 9/2007 |
| WO | 2007/114777 | A1 | 10/2007 |
| WO | 2008/139651 | A1 | 11/2008 |

OTHER PUBLICATIONS

Patent Cooperation Treaty, "International Search Report and Written Opinion of the International Searching Authority" International Application No. PCT/US2013/065070 of Mikutay Corporation; dated Mar. 6, 2014; 11 pages.

Patent Cooperation Treaty, "International Search Report and Written Opinion of the International Searching Authority" International Application No. PCT/US2017/025078 of Mikutay Corporation; dated Jun. 22, 2017; 5 pages.

Patent Office of the Russian Federation, "Decision on Grant, A Patent for Invention, Report on Results of Examination" re: Patent Application Serial No. 2010147367/06(068438); dated Jul. 17, 2012, 20 pages.

Korean Intellectual Property Office, "Notice of Preliminary Rejection" re: Patent Application Serial No. 10-2010-7025911, dated Jun. 1, 2012, 7 pages.

Japanese Patent Office, "Notification of Reasons for Rejection" re: Patent Application Serial No. 2011-506261, Drafting Date: May 24, 2012, 6 pages.

State Intellectual Property Office of the People's Republic of China, "Notice of Second Office Action" Patent Application No. 200980114176.7 of Mikutay Corporation; dated Aug. 16, 2012; 60 pages.

State Intellectual Property Office of the People's Republic of China, "Notice of Third Office Action" Patent Application No. 200980114176.7 of Mikutay Corporation; dated Jan. 29, 2013; 62 pages.

State Intellectual Property Office of the People's Republic of China, "Notice of Fourth Office Action" Patent Application No. 200980114176.7 of Mikutay Corporation; dated Nov. 12, 2013; 65 pages.

Japanese Patent Office, "Notification of Reasons for Rejection" re: Patent Application Serial No. 2005-500686, dated Jun. 8, 2016, 9 pages.

(56) References Cited

OTHER PUBLICATIONS

India Patent Office, "First Examination Report" re Patent Application Serial No. 4289/KOLNP/2010, dated May 29, 2017, 8 pages.
European Patent Office, "Supplementary European Search Report" re: Patent Application No. 13854762.5, dated Dec. 8, 2015; 8 Pages.

* cited by examiner

HEAT EXCHANGER UTILIZED AS AN EGR COOLER IN A GAS RECIRCULATION SYSTEM

FIELD OF INVENTION

The present invention relates to a heat exchanger, and in particular to heat exchange utilized as a cooler in an engine gas recirculation (EGR) system for an internal combustion engine.

DISCUSSION OF THE RELATED ART

A heat exchanger commonly called an EGR cooler is used extensively in internal combustion engines as a vital component of an engine gas recirculation (EGR) system. In the EGR system, a portion of exhaust gas taken out of a combustion chamber of an engine is diverted by a regulating valve to an EGR cooler to be cooled. Exhaust gas cooled by the EGR cooler is returned to the combustion chamber, where the cooled exhaust gas is mixed with fresh air taken in from an intake manifold of the engine. The EGR system is typically utilized to enhance fuel efficiency of an internal combustion engine, as well as to minimize emissions of environmentally harmful gases such as Nitrogen Oxide (NOx). The EGR system cools the exhaust gas by passing the hot exhaust gas through an EGR cooler. Applying cooled exhaust gas to the combustion chamber reduces Nitrogen Oxide formation, while improving engine efficiency. The engine may be a gasoline engine, a diesel engine, or powered by some other combustible fuel suitable to drive an internal combustion engine.

Heat exchanger designs suitable for use as an EGR cooler are known in various forms. A typical EGR cooler comprises a plurality of generally smooth round tubes arranged inside a watertight vessel. Cooling fluid, often engine coolant plumbed in from a cooling loop of an engine, is circulated over the exterior of the tubes. In a typical EGR cooler, as hot exhaust gas is introduced into one end of the plurality of tubes and flows through the tubes, the gas is cooled by the cooling fluid surrounding the plurality of tubes. An EGR cooler utilizing such a design suffers from low heat transfer efficiency. The heat transfer efficiency is low because the exhaust gas flows straight through the individual tubes to transfer heat away from the exhaust gas to the surrounding cooling fluid. As heat transfer efficiency of an EGR cooler of this design is not very efficient, the overall dimensions of such an EGR cooler tend to be rather large. As the dimensions are large, the cooler tends to be heavy and requires a substantial amount of raw material to assemble. As EGR coolers of this design are large, they may also cause location issues due to the limited space available in a typical engine compartment of a vehicle.

The round tube style EGR cooler design may be improved by adding surface enhancements to the tubular surface, whereby the surface enhancements induce turbulence to the exhaust gas flow. In an EGR cooler of this design, the surface enhancements are typically made to the inner tubular surface. The surface enhancements may be dimples, a plurality of fin like structures, or some other surface enhancements, which may facilitate turbulent flow of the exhaust gas as it flows through the individual tubes. Although this improves heat transfer efficiency over the smooth round tube design, the performance improvement is rather limited. Additionally, with long term use of an EGR cooler with such a design, contaminants commonly contained in the exhaust gas of an internal combustion engine may clog up such surface enhancements, rendering the surface enhancements useless. Furthermore, a clogged EGR cooler may render the EGR cooler ineffective, causing reduced service life of the EGR system, or in a worst case scenario, lead to a catastrophic engine failure.

Further improvement to an EGR cooler design has been accomplished by incorporating offset fins commonly utilized in the art of heat exchanging device design to improve heat transfer efficiency. In this design, instead of utilizing round tubular structures to transport exhaust gas, generally rectangular multi-component tubes are utilized. To enhance heat transfer efficiency, the internal exhaust gas flow path provided within the rectangular tube is populated with offset fins. The offset fins improve heat transfer efficiency by creating multiple interruptions to the flow of the exhaust gas. With each interruption, fresh heat transfer boundary layers are created, improving transfer of the heat contained within the exhaust gas to the cooling fluid. Although utilization of offset fins offers improvement in heat transfer efficiency over the round tube design or the enhanced round tube design, there are several drawbacks to the design. As this design requires additional offset fin material to be added to the inside of the rectangular tubular structure, the EGR cooler of this design may suffer from heavier weight. Further, since the offset fins need to be precisely aligned within the rectangular tubes, the assembly process is complicated. Also, as offset fins function by creating multiple interruptions to the flow of the exhaust gas, significant pressure drop of the exhaust gas may be expected, which may be detrimental to heat exchanger operation.

As pressure drop is generally detrimental to the performance of a heat exchanging device, the benefits obtained by utilization of offset fins may be outweighed by its drawbacks. Furthermore, as the offset fin pitch must be relatively small to be effective, typically offering very little opening from one fin structure to the next, heat exchangers of this design are prone to plugging, rendering the heat exchanger inoperable, or in the worst case scenario, causing irreparable damage to the engine. Additionally, as offset fin design heat exchanging devices require the exhaust gas to interact with multiple offset fins as the gas travels axially along the length of the rectangular tube, heat exchanging devices of this kind tend to have a long lateral length along the axis of the exhaust gas flow path, limiting the flexibility of the heat exchanger design in an effort to provide a compact EGR cooler. In order to combat negative aspects of the offset fin design, the pitch of fins may be reduced or the overall number of fins populated within the rectangular tubes may be minimized. However, such modifications significantly reduce the heat transfer effectiveness, limiting their usefulness in actual application.

Additionally, in this EGR cooler design, a plurality of rectangular tubular sections are generally stacked together with a slight spatial separation between the individual tubular sections to allow flow of the cooling medium to pass therethrough. In order to maintain relatively compact dimensions of an EGR cooler with this design, the spatial separation between the individual tubular sections may be minimized. As the EGR cooler may be exposed to extremely high temperatures, reaching beyond 600 degrees Celsius in some instances, the reduced flow paths for the cooling medium may cause hot spots within the cooling passages of the cooling medium. The creation of hot spots within the cooling passages may induce boiling of the cooling fluid, reducing the overall heat transfer effectiveness of the heat exchanger, or in the worst case scenario, cause the rectangular tubular section to melt, causing a catastrophic failure of the EGR cooler, and in some instances the catastrophic failure of the engine itself.

SUMMARY OF THE INVENTION

The present invention provides a heat exchanger well suited for handling heat exchange medium containing large amounts of contaminants such as carbon or soot. The present invention minimizes the deposits of such contaminants within the heat exchanger by utilizing a flow path comprising a plurality of tube sections, chamber sections, and medium directing components, which when combined provide a mixing and turbulence inducing motion to the heat exchange medium, without having to incorporate additional flow interrupting component features in the flow path of the heat exchange medium, such as offset fins or other flow altering secondary surface features. In addition, the mixing and turbulence inducing motion of the heat exchange medium improves the heat exchange efficiency of the EGR cooler, making it possible to design a more compact heat exchanger compared to a heat exchanger of a conventional EGR cooler.

The present invention is a heat exchanger with an inlet for a first heat exchange medium. The first heat exchange medium may be exhaust gas piped in from a combustion chamber of an internal combustion engine, for example. The first heat exchange medium contains heat which is transferred to a second heat exchange medium. The heat exchanger has a discharge output for the first heat exchange medium. The discharged first heat transfer medium may be directed out to be mixed with fresh air inducted by the fresh air intake of the engine. The mixed gas may then be fed into the combustion chamber of the engine to complete the combustion process as desired.

The heat exchanger also has a feed inlet for a second heat exchange medium. The second heat exchange medium may be coolant piped in from a cooling system of the engine, for example. The second heat exchange medium typically has a temperature lower than the temperature of the first heat exchange medium, thereby facilitating transfer of heat away from the first heat exchange medium to the second heat exchange medium. The heat exchanger has a containment vessel for the second heat exchange medium, and includes a discharge outlet for the second heat exchange medium, whereby the second heat exchange medium may be returned to the coolant system of the engine cooling system, for example. The containment vessel utilized to contain the second heat exchange medium also provides a desired flow pattern to the second heat exchange medium.

The first heat exchange medium is provided with a plurality of flow paths where the flow paths allows heat contained within the first heat exchange medium to come into contact with the second heat transfer medium, while maintaining spatial separation between the first medium and the second medium. A flow path is provided by a flow path assembly having tubular sections, a chamber section, and a medium directing component. These components facilitate mixing inducing flow as well as turbulence inducing flow to the first heat exchange medium, while simultaneously permitting the lengthening of the flow path within a provided axial space to enhance heat transfer performance. A plurality of tubular sections, chamber sections, and medium directing components may be coupled together to form a substantially longer medium flow path than the actual physical axial length of the flow path. As such, the actual physical axial length of the flow path may be 1, while the overall length of the heat exchange medium flow pathway may be substantially greater than 1.

A flow path assembly illustratively comprises a first tubular section, a chamber section, a second tubular section, and a medium directing component within the chamber section. In a typical embodiment of the present invention, the flow path assembly first comprises a generally straight first tubular section. The first tubular section is hollow, permitting flow of heat exchange medium within. As the first tubular section terminates, the heat exchange medium flowing within the first tubular section is introduced to a first angled surface of the medium directing component within the chamber section. The first surface of the medium directing component has an inclined surface, generally diverting the flow of the heat exchange medium from the generally straight flow pattern within the first tubular section to nearly a perpendicular flow pattern in relation to the initial line of flow. As the heat exchange medium flow is diverted to a generally perpendicular flow, the heat exchange medium is introduced into the chamber assembly. A first planar surface of the chamber assembly is coupled to the first tubular section in a watertight manner. The first planar surface of the chamber assembly is provided with an orifice to permit flow of the heat exchange medium from the first tubular section to the interior of the chamber assembly. The chamber assembly is hollow, permitting flow of heat exchange medium within. The interior of the chamber assembly comprises the first planar surface and a second planar surface, spaced apart, leaving a space between the respective planar surfaces. The first planar surface and the second planar surface may be joined together by a lateral wall of the chamber assembly, the lateral wall of the chamber assembly being connected concentrical to the first planar surface on the outer periphery of the first planar surface, and also being connected concentrically to the second planar surface on the outer periphery of the second planar surface in a watertight manner, forming the chamber assembly. The diameter of the chamber assembly is generally greater than the diameter of the first tubular section, while the length of the chamber assembly is generally substantially shorter than the axial length of the overall flow path. As the heat exchange medium is directed into the interior of the chamber assembly, the heat exchange medium is directed towards one end of the chamber assembly. Once the heat exchange medium reaches the one end of the chamber assembly, the flow of the heat exchange medium is diverted into two divergent flow patterns, generally symmetrical to one another, in a semi-circular manner within the chamber assembly. The two semi-circular flow patterns generally flow away from each other, while axially aligned to one another, following the contour of the interior of the chamber assembly. The configuration of the interior contour of the chamber assembly acts to direct and channel the flow of the heat exchange medium within the chamber assembly.

As the two semi-circular heat exchange medium flow paths complete their flow, following along the interior contour of the chamber assembly, the two semi-circular flow paths converge to form one single flow once again. The point at which the two semi-circular flow paths converge is generally on the opposite side of the initial point at which the heat exchange medium flow diverged into two separate flow paths. As the two semi-circular flows converge into one, the heat exchange medium flow direction is simultaneously directed in a new flow direction, wherein the angle of an attack of the new flow direction is substantially divergent from the respective lines of flow of each semi-circular flow path. As the two semi-circular flow paths within the chamber assembly converge and are directed toward the new flow angle of attack, the converged flow of heat exchange medium is directed toward a second surface of the medium directing component. The second surface of the medium directing component has an inclined surface, generally diverting the flow of the heat exchange medium to nearly a perpendicular flow pattern, axially aligned to the axis of a second tubular section. The second surface of the medium directing component is generally on the side opposite of the first surface of the medium directing component. The second tubular section is fluidly connected to the second planar surface of the chamber assembly. The second planar surface of the chamber assembly is provided with an orifice to permit flow of the heat exchange medium from the interior of the chamber assembly into the second tubular section. A flow path assembly may comprise a plurality of tube, chamber, and medium directing component assemblies. As such, the flow described pattern herein may be repeated several times dependent upon the number of tubular sections, chamber sections, and medium directing components contained within a particular flow path.

As the heat exchange medium flows inside the flow path, the heat exchange medium encounters a plurality of obstacles that force fluid flow directional changes that disrupt heat transfer boundary layers, which in turn improves heat transfer effectiveness of the heat transfer medium, as well as minimize the depositing of contaminants contained in the heat exchange medium to the flow path surface. In the preferred embodiment of the present invention, the flow pattern is accomplished without addition of secondary surface features in the heat exchange medium pathway, such as an offset fin or other structures known in the art.

The heat exchanger includes a first header plate to which the first end of each of the flow path assemblies is coupled. The first header plate provides a predetermined spacing and arrangement for the flow path assemblies. The first header plate also provides a spatial separation between the first heat exchange medium and the second heat exchange medium. The first header plate is provided with a plurality of throughholes for the individual flow paths, thereby permitting flow of the heat exchange medium from one side of the first header plate, through the first header plate, and then to the individual flow paths. In an embodiment of the present invention, the first header plate may be coupled to a first collector tank. The first collector tank may be coupled to the first header plate, providing a watertight connection. The first collector tank is provided with at least one inlet to introduce the first medium into the first collector tank. In an embodiment of the present invention, the leading edge of the plurality of throughholes for the individual flow paths formed on the first header plate may be provided with a chamfer or a rounded radius feature to minimize pressure drop of the heat exchange medium flowing into the plurality of flow paths. In yet another embodiment of the present invention, only a portion of the leading edge of the plurality of throughholes for the individual flow paths formed on the first header plate may be provided with a chamber or a rounded radius.

The heat exchanger is provided with a second header plate to which the second end of each of the flow path assemblies is coupled. The second header plate maintains the predetermined spacing and arrangement for the flow path assemblies. The second header plate also provides a spatial separation between the first heat exchange medium and the second heat exchange medium. The second header plate is provided with a plurality of throughholes for the individual flow paths, thereby permitting flow of the first heat exchange medium from the plurality of flow paths to flow through the second header plate, to discharge the heat exchange medium out of the plurality of flow paths. The second header plate may be coupled to a second collector tank, the second collector tank including at least one outlet for discharging the first heat exchange medium out of the heat exchanger. The second collector tank may be coupled to the second header plate, providing a watertight connection. In an embodiment of the present invention, the trailing edge of the plurality of throughholes for the individual flow paths formed on the second header plate may be provided with a chamfer or a rounded radius feature to minimize pressure drop of the heat exchange medium flowing into the plurality of flow paths. In yet another embodiment of the present invention, only a portion of the trailing edge of the plurality of throughholes for the individual flow paths formed on the second header plate may be provided with a chamfer or a rounded radius.

In a preferred embodiment of the present invention, the outside diameter of a chamber section is substantially larger than the outside diameter of a tubular section. Further, a plurality of flow path assemblies are arranged in a predetermined arrangement and spacing between the first header plate and the second header plate. In a preferred embodiment, a first flow path assembly and a second flow path assembly are arranged so that a first chamber section of the second flow path assembly is located substantially adjacent to the tubular section of the first flow path assembly, interposed between a first chamber section and a second chamber section of the first flow path assembly. Similarly, a first tubular section of the second flow path assembly is arranged substantially adjacent to the first chamber section of the first flow path assembly. Furthermore, the position of the second flow path assembly is arranged in relation to the first flow path, wherein the outer circumference of the chamber section of the first flow path assembly overlaps the outer circumference of the chamber of the second flow path assembly. In an embodiment of the present invention, the first flow path assembly and the second flow path assembly are positioned, such that the first flow path assembly and second flow path assembly are spaced apart, allowing flow of a second heat exchange medium between the first flow path assembly and the second flow path assembly. In another embodiment of the present invention, the first flow path assembly and the second flow path assembly are positioned, such that the first flow path and the second flow path are in contact with one another. The arrangement of tube sections and chamber sections as described provide multiple interruptions to the flow of the second heat exchange medium flowing around the plurality of flow path assemblies, thereby enhancing the heat transfer effectiveness of the second heat exchange medium.

In an embodiment of the present invention, the throughholes on the first header plate and the throughholes on the second header plate are aligned, mirroring each other, thereby arranging the individual flow paths to be parallel to each other. In another embodiment of the present invention, the throughholes on the first header plate and the throughholes on the second header plate are not aligned to mirror each other, thereby arranging the individual flow paths to be not parallel to each other.

In a preferred embodiment of the present invention, the heat exchanger is provided with at least one inlet to introduce the cooling medium. The inlet of the second heat exchange medium is coupled to a first tank to facilitate distribution of the second heat exchange medium while minimizing pressure drop of the second heat exchange medium by providing a distribution plate with an adequate quantity of throughholes of an adequate size. The first tank for the second heat exchange medium may be coupled to a first distribution plate, which may be utilized to distribute the second heat exchange medium as desired to the outer surface of the plurality of flow path assemblies carrying the first heat exchange medium. The first distribution plate is generally planar, provided with a plurality of throughholes to permit flow of the second heat exchange medium therethrough. As the second heat exchange medium flows between the plurality of flow path assemblies carrying the first heat exchange medium within the cooling medium vessel, the heat contained within the first heat exchange medium is transferred to the second heat exchange medium. On the plane opposite of the first distribution plate of the cooling medium vessel is a second distribution plate. The second distribution plate may be provided with a plurality of throughholes to permit flow of the second heat exchange medium therethrough. The second distribution plate may be coupled to a second tank for the second heat exchange medium, which in turn may be provided with at least one output to discharge the second heat exchange medium out of the heat exchanger.

The cooling medium vessel comprises six planes provided by the first header plate of the first heat exchange medium, the second header plate of the first heat exchange medium, the first distribution plate of the second heat exchange medium, the second distribution plate of the second heat exchange medium, a first case body lateral panel, and a second case body lateral panel. The plurality of flow path assemblies for the first heat exchange medium are positioned within the compartment created by the six planes.

In a preferred embodiment of the present invention, the cooling medium vessel may be rectangular or square in shape. The first two parallel planes comprising the cooling medium vessel, formed by the first header plate and the second header plate, are set spaced apart at a predetermined distance. The second two parallel planes comprising the cooling medium vessel, formed by the first distribution plate and the second distribution plate, are set spaced apart at a predetermined distance. In a preferred embodiment, the first header plate may be set generally perpendicular to the first distribution plate and the second distribution plate. The second header plate may also be set generally perpendicular to the first distribution plate and the second distribution plate. In another embodiment of the present invention, the cooling medium vessel may not be rectangular or square in shape. In such an embodiment, the first header plate is not perpendicular to the first distribution plate and the second distribution plate. The second header plate may not be perpendicular to the first distribution plate and the second distribution plate.

The tubular sections of the flow path assemblies may be hollow with a round tubular shape. In another embodiment, the tubular sections of the flow path assemblies may be a rectangle or another geometric shape, such as a triangle or a trapezoidal shape, for example. The interior wall of a tubular section of a flow path assembly may be smooth, or it may contain surface enhancements, such as dimples or other structural shapes to induce turbulence. The outer exterior wall of a tubular section of the flow path assembly may be smooth, or it may contain surface enhancements. The enhancements may be fin like structures, dimples or some other structural shape to induce turbulence or to increase surface area of the tubular section.

The tube and the chamber sections of the flow path assemblies may be made of ferrous or non-ferrous material. The material may be stainless steel or aluminum, either with cladding or without cladding. The tube and chamber sections of the flow path assembly may also be made of stainless steel, copper or other ferrous or non-ferrous materials. The tube and chamber sections of the flow path assemblies may also be a plastic material or of composite materials. The individual components may be brazed together utilizing cladded material or brazing paste.

The tube and chamber sections of the flow path assemblies may be manufactured by stamping, cold forging, machining, or by other manufacturing methods known in the art. The tube and chamber sections of a flow path assembly may be manufactured as one piece or may be manufactured as separate pieces. The heat exchanger may be coupled together by means of brazing, soldering, or welding.

Other features and advantages of the present invention will be readily appreciated, as the same becomes better understood after reading the subsequent description taken in conjunction with the accompanying drawings.

DETAILED DESCRIPTION

Figure 1:
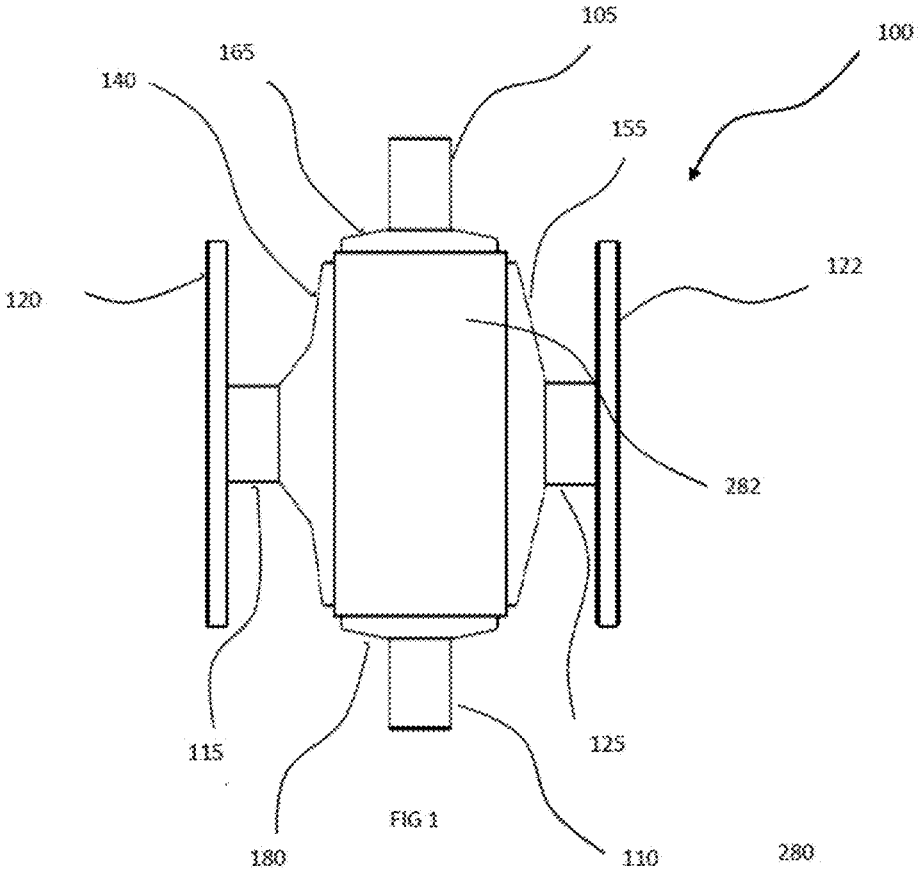
FIG. 1 is a side view of a heat exchanger according to an embodiment of the present invention.
Figure 2:
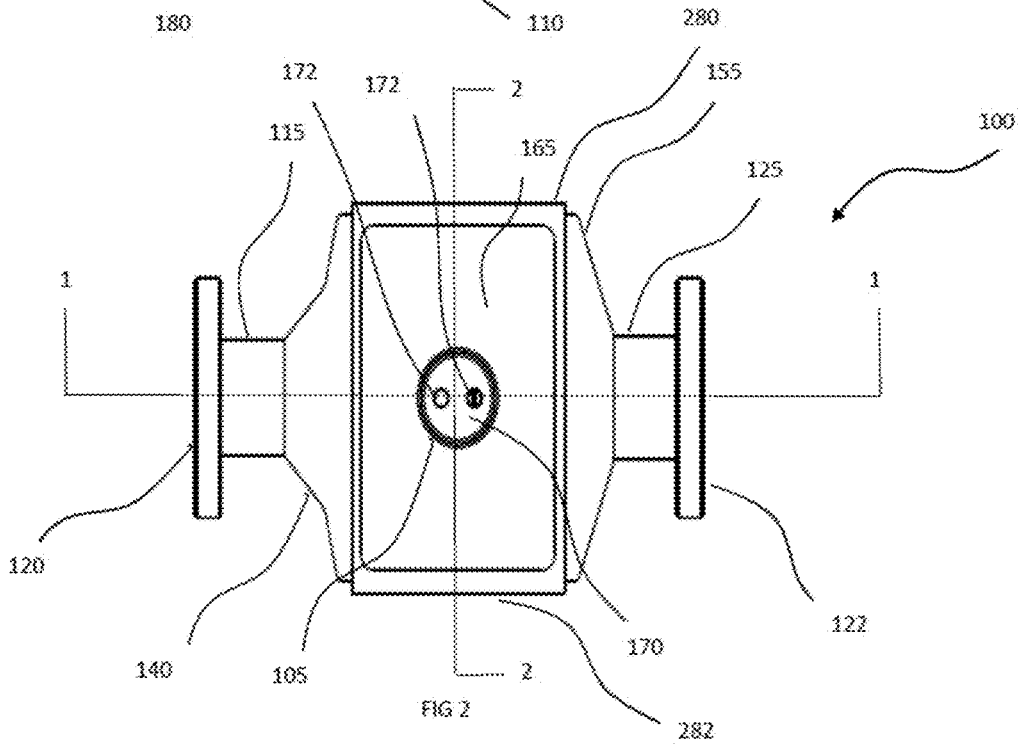
FIG. 2 is a top view of the heat exchanger according to an embodiment of the present invention.

Referring to the drawings and in particular FIG. 1 and FIG. 2, an embodiment of a heat exchanger 100 is shown. In an EGR cooler application, heat exchange medium being cooled is typically exhaust gas from an internal combustion engine. The cooling medium is typically engine coolant diverted from a cooling loop of an internal combustion engine. The heat exchanger 100 includes a cooling medium inlet side tank 165, a cooling medium outlet side tank 180, an exhaust gas inlet side tank 140 and an exhaust gas outlet side tank 155.

The heat exchanger 100 is provided with an exhaust gas inlet pipe 115 to facilitate flow of exhaust gas into the heat exchanger 100 via the exhaust gas inlet side tank 140. The exhaust gas inlet pipe 115 is hollow, permitting flow of exhaust gas therethrough. A first flange 120 is coupled to the gas inlet pipe 115 to facilitate attachment of the heat exchange 100 to an exhaust gas source. The first flange 120 is generally planar, provided with a generally flat surface to facilitate secure sealing. The first flange 120 may also be provided with a securing mechanism to couple the first flange 120 to the exhaust gas source, by utilizing nuts and bolts, for example. To permit use of nuts and bolts for attachment purposes, the first flange 120 may be provided with a plurality of bolt holes 305 (see FIGS. 3 and 7). The exhaust gas inlet pipe 115 may be coupled to the exhaust gas inlet tank 140 by brazing, soldering, or welding. The exhaust gas inlet pipe 115 may also be coupled to the exhaust gas inlet tank by mechanical means, such as flaring, for example. The exhaust gas inlet pipe 115 may also be coupled to the first flange 120 by brazing, soldering, or welding, or by mechanical means, such as flaring, for example. A combination of two or more coupling methods may also be used.

The heat exchanger 100 is also provided with an exhaust gas outlet pipe 125 to facilitate discharge of cooled exhaust gas out of the heat exchanger 100 via the exhaust gas outlet side tank 155. The exhaust gas output pipe 125 is hollow, permitting flow of exhaust gas therethrough. The exhaust gas output 125 may be provided with a second flange 122 to facilitate attachment of the heat exchanger 100 to an exhaust gas discharge output. The second flange 122 is generally planar, provided with a generally flat surface to facilitate secure sealing. The second flange 122 may also be provided with a securing mechanism to couple the second flange 122 to the exhaust gas discharge output, by utilizing nuts and bolts, for example. To permit use of nuts and bolts for attachment purposes, the second flange 122 may be provided with a plurality of bolt holes 305 (see FIGS. 3 and 7). The exhaust gas outlet pipe 125 may be coupled to the exhaust gas outlet side tank 155 by brazing, soldering, or welding. The exhaust gas outlet pipe 125 may also be coupled to the exhaust gas outlet side tank by mechanical means, such as flaring, for example. The exhaust gas outlet pipe 125 may also be coupled to the second flange 122 by brazing, soldering, or welding, or by mechanical means, such as flaring, for example. A combination of two or more coupling methods may also be used.

In a preferred embodiment of the present invention, one exhaust gas inlet pipe 115 and one exhaust gas outlet pipe 125 are provided. In other embodiments of the present invention, a plurality of exhaust gas inlet pipes 115 may be provided. In yet another embodiment of the present invention, a plurality of exhaust gas outlet pipes 125 may be provided.

Referring again to FIG. 1, the heat exchanger 100 is provided with a cooling medium inlet pipe 105 to permit flow of cooling medium into the heat exchanger 100 via the cooling medium inlet side tank 165. The heat exchanger 100 is also provided with a cooling medium outlet pipe 110 to permit discharge of cooling medium out of the heat exchanger 100 via the cooling medium outlet side tank 180. In one embodiment of the present invention, one cooling medium inlet pipe 105 and one cooling medium outlet pipe 110 are provided. In other embodiments of the present invention, a plurality of cooling medium inlet pipes 105 may be provided. In yet another embodiment of the present invention, a plurality of cooling medium outlet pipes 110 may be provided. The cooling medium inlet pipe 105 and cooling medium outlet pipe 110 are hollow, permitting flow of cooling medium therethrough.

Figure 7:
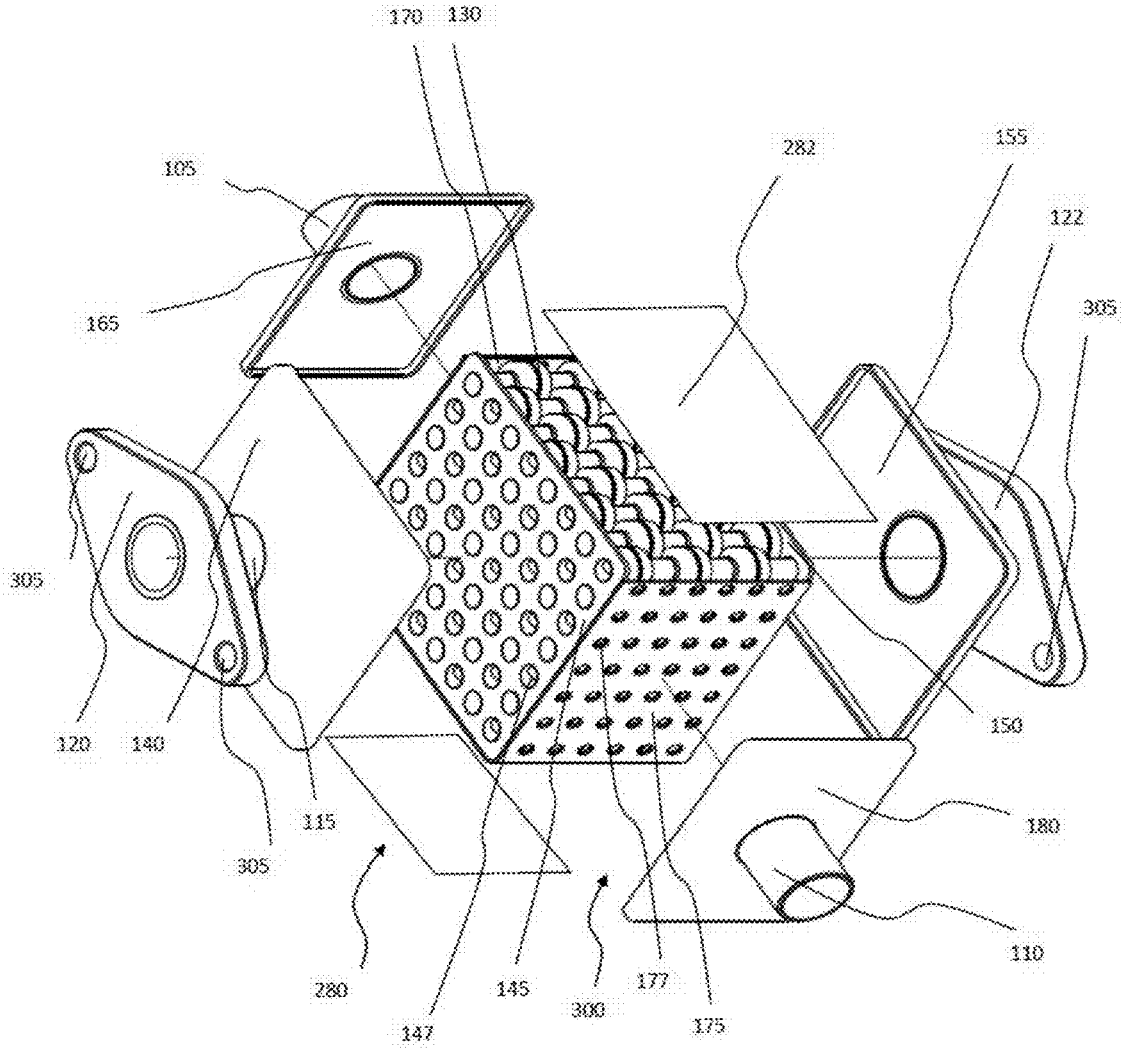
FIG. 7 is an exploded perspective view of a heat exchanger according to an embodiment of the present invention.

Referring to FIG. 7, an exploded perspective view of a heat exchanger 100 according to an embodiment of the present invention is shown. The heat exchanger body may be generally rectangular or square in shape and includes three pairs of planar faces. The first pair of planar faces comprises an input header plate 145 and an output header plate 150. The input header plate 145 and the output plate header plate 150 are generally rectangular or square in shape. The input header plate 145 has a plurality of orifices 147, and the output header plate 150 has the same number of orifices 152 (not visible in FIG. 7). Each input header orifice 147 is preferably axially aligned with a corresponding output header orifice 152, and a flow path assembly 130 extends between each axially aligned pair of input header orifices and output header orifices.

The second pair of planar faces forming the heat exchanger body consists of an input distribution plate 170 and an output distribution plate 175. The input distribution plate 170 and the output distribution plate 175 are generally rectangular or square in shape. The front edge of the input distribution plate 170 is coupled to one edge of the input header plate 145. The front edge of the output distribution plate 175 is coupled to the opposite edge of the input header plate 145. The back edge of the input distribution plate 170 is coupled to one edge of the output header plate 150. The back edge of the output distribution plate 175 is coupled to the opposite edge of the output header plate 150. The input distribution plate 170 has a plurality of orifices 172 (not visible in FIG. 7). The outlet distribution plate 175 has a plurality of orifices 177. In a preferred embodiment, the input distribution plate 170 and the outlet distribution plate 175 have the same number of orifices, and in the most preferred embodiment, an input distribution plate orifice 172 is axially aligned with an output distribution plate orifice 177.

The two remaining planes of the heat exchanger body comprise a first case body lateral panel 280 and a second case body lateral panel 282. The front edge of the first case body lateral panel 280 is coupled to a first side edge of the input header plate 145, and the back edge of the first case body lateral panel 280 is coupled to a first side edge of the output header plate 150. The first case body lateral panel 280 is also coupled to a first side edge of the input distribution plate 170 and a first side edge of the output distribution plate 175. The second case body lateral panel 282 is coupled to a second side edge of the input header plate 145 and a second side edge of the output header plate 150. The second case body lateral panel 282 is also coupled to a second side edge of the input distribution plate 170 and a second side edge of the output distribution plate 175. The input header plate 145, the output header plate 150, the input distribution plate 170, the output distribution plate 175, the first case body lateral panel 280, and the second case body lateral panel 282 are coupled together to form the heat exchanger case body 300.

On the outwardly facing surface of the input header plate 145, the exhaust gas inlet side tank 140 is sealingly coupled. The exhaust gas inlet side tank body 140 is provided with the exhaust gas inlet pipe 115 to introduce exhaust gas into the heat exchanger 100. On the outwardly facing surface of the output header plate 150, the exhaust gas outlet side tank 155 is sealingly coupled. The exhaust gas outlet side tank 155 is provided with the exhaust gas outlet pipe, to discharge exhaust gas out of the heat exchanger 100. On the outwardly facing surface of the distribution plate 170, the cooling medium inlet side tank 165 is sealingly coupled. The cooling medium inlet side tank 165 is provided with the cooling medium inlet pipe 105 to introduce cooling medium into the heat exchanger 100. On the outwardly facing surface of the output distribution plate 175, the cooling medium outlet side tank 180 is sealingly coupled. The cooling medium outlet side tank 180 is provided with the cooling medium outlet pipe 110 to discharge cooling medium out of the heat exchanger 100.

Figure 3:
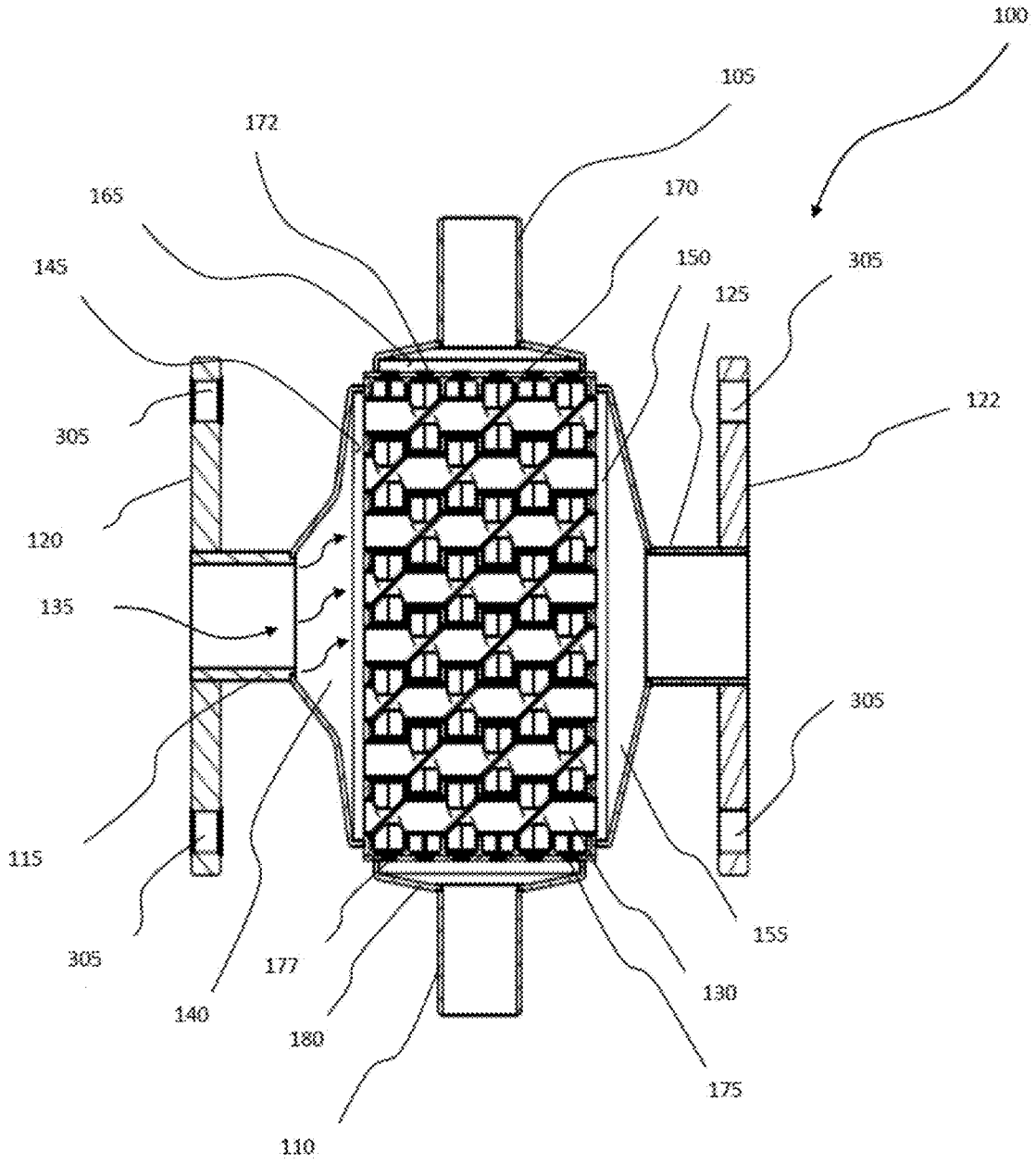
FIG. 3 is a cross-sectional view of the heat exchanger taken along the line 1-1 of FIG. 2.
Figure 4:
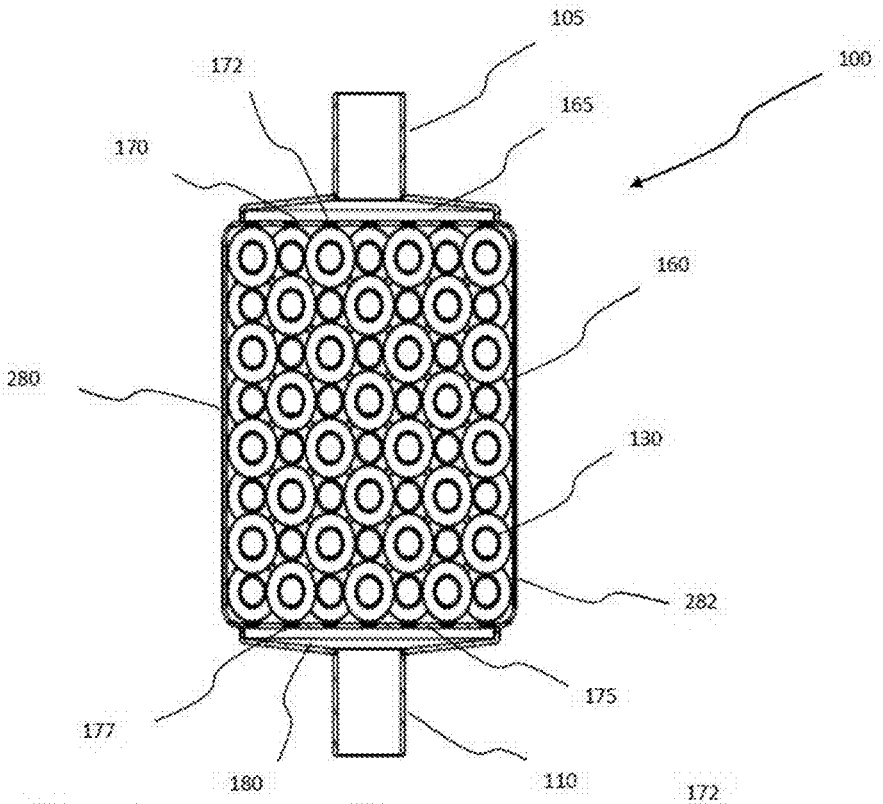
FIG. 4 is a cross-sectional view of the heat exchanger taken along the line 2-2 of FIG. 2.

Reference is now made to FIGS. 3 and 4, FIG. 3 being a cross-sectional view taken along the line 1-1 of FIG. 2, and FIG. 4 being a cross-sectional view taken along the line 2-2 of FIG. 2. Exhaust gas travelling through the exhaust gas inlet pipe 115 is introduced into the exhaust gas inlet side tank 140. The exhaust gas inlet side tank 140 is in fluid communication with the input header plate 145. The input header plate 145 is provided with the plurality of input header plate orifices 147. A first end of a flow path assembly 130 is matingly coupled to each of the input header plate orifices 147 provided in the input header plate 145. A flow path assembly 130 may by brazed, soldered, welded, or mechanically coupled to the input header plate 145. Preferably there are a plurality of input header plate orifices 147 on the input header plate 145 and a like plurality of flow path assemblies 130. Exhaust gas introduced into the exhaust gas inlet side tank 140 flows through an input header plate orifice 147 into one or a plurality of flow path assemblies 130. A second end of a flow path assembly 130 is matingly coupled to the output header plate 150. The output header plate 150 is provided with a plurality of output header plate orifices 152, each of which is in fluid communication with the second end of a flow path assembly 130. The flow path assembly 130 may be brazed, soldered, welded, or mechanically coupled to the output header plate 150. Exhaust gas that has completed flow through the plurality of flow path assemblies 130 flows through the output header plate orifices 152 and is discharged into the exhaust gas outlet side tank 155. Once the exhaust gas is collected in the exhaust gas outlet side tank 155, the exhaust gas is discharged out of the heat exchanger 100 via the exhaust gas outlet pipe 125 coupled to the exhaust gas outlet side tank 155.

Cooling medium traveling through the cooling medium inlet 105 is introduced into the cooling medium inlet side tank 165 and then into the heat exchanger body 300, via the orifices 172 in the input distribution plate 170. The coolant travels through the heat exchanger, around the exterior surfaces of the flow path assemblies 130 and then through the orifices 177 in the output distribution plate 175. The coolant then collects in the cooling medium outlet side tank 180 and is discharged out of the heat exchanger via the cooling medium outlet 110.

With reference to FIG. 3, the exhaust gas (left to right) flow path 135 is through the exhaust gas inlet 115, the gas inlet side tank 140, the orifices 147 within the input header plate 145, the interior of the respective flow path assemblies 130, the orifices 152 in the output header plate 150, the gas outlet side tank 155 and the exhaust gas outlet 125. With reference to FIGS. 3 and 4, the coolant (top to bottom) flow path is through the cooling medium inlet 105, the cooling medium inlet side tank 165, the orifices 172 in the input distribution plate 170, around the exterior surfaces of the respective flow path assemblies 130, the orifices 177 in the output distribution plate 175, the cooling medium outlet side tank 180 and the cooling medium outlet 110.

A water tight vessel 160 for the cooling medium is provided by the cooling medium inlet side tank 105, the non-orifice portions of the input and output header plates 145, 150, the first and second case body lateral panels 280, 282, and the cooling medium outlet side tank 180. The flow path assemblies 130 are also within the vessel 160, with the exterior surfaces of the flow path assemblies coming into contact with the coolant. The heat contained within the exhaust gas flowing within the interior of the flow path assemblies 130 is transferred via the assemblies to the coolant and is removed as the coolant is circulated through the vessel 160 and the cooling system of the engine.

Figure 5A:
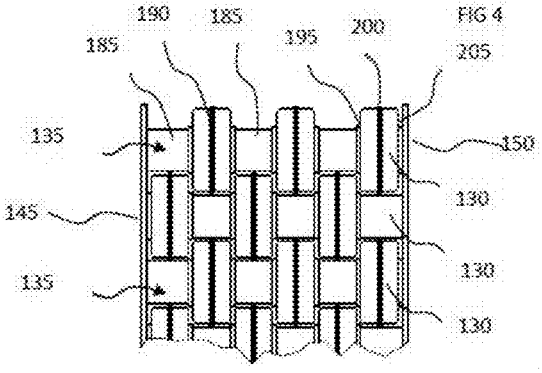
FIG. 5A is a side view of a core assembly according to an embodiment of the present invention.

Referring to FIG. 5A, a flow path assembly 130 disposed between the input header plate 145 and the output header plate 150 comprises at least one chamber assembly 190 disposed between two tube sections 185. In combination, the tube sections 185 and chamber assemblies provide flows paths 135 for the exhaust gas. As shown in FIG. 5A (see also FIG. 6B), each chamber assembly 190 has a pair of planar walls 195, 205, and a lateral wall 200 which connects the first and second planar walls.

Figure 5B:
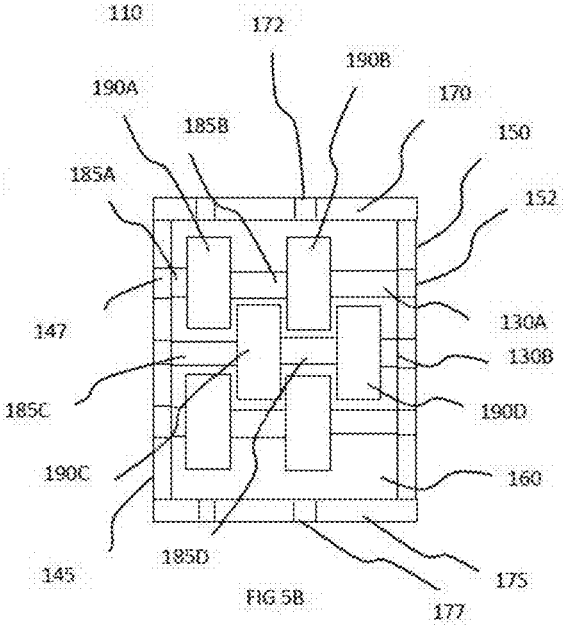
FIG. 5B is a schematic side view of a core assembly according to an embodiment of the present invention.
Figure 5C:
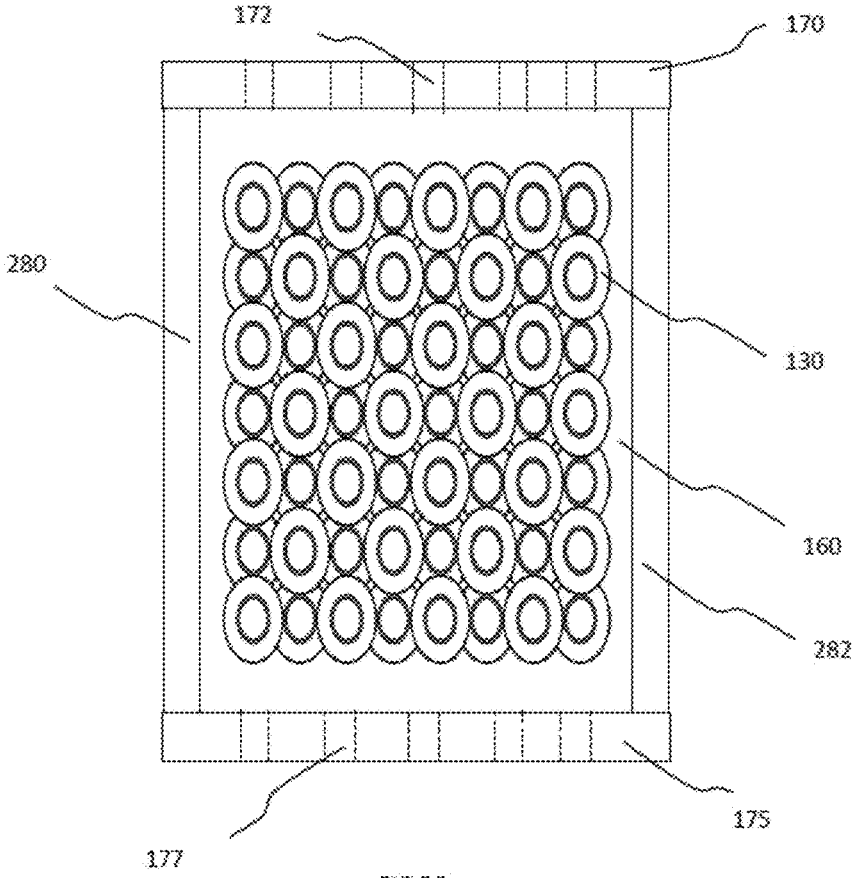
FIG. 5C is a schematic front view of a core assembly according to an embodiment of the present invention.

Referring now to FIG. 5B and FIG. 5C, a first flow path assembly 130A and a second flow path assembly 130B are arranged so that a chamber section 190C of the second flow path assembly 130B is located substantially adjacent to a tubular section 185B of the first flow path assembly 130A, interposed between a first chamber section 190A and a second chamber section 190B of the first flow path assembly 130A. Similarly, a first tubular section 185C of the second flow path assembly 130B is arranged substantially adjacent to the first chamber section 190A of the first flow path assembly 130A. Furthermore, the position of the second flow path assembly 130B is arranged in relation to the first flow path assembly 130A, such that the outer circumference of the chamber section 190A and of the chamber section 190B of the first flow path assembly 130A overlap the outer circumference of the chamber section 190C and of the chamber section 190D of the second flow path assembly 130B. In an embodiment of the present invention, the first flow path assembly 130A and the second flow path assembly 130B are positioned, such that the first flow path assembly 130A and second flow path assembly 130B are spaced apart, allowing flow of heat exchange medium between the first flow path assembly 130A and the second flow path assembly 130B. In another embodiment of the present invention, the first flow path assembly 130A and the second flow path assembly 130B are positioned, such that the first flow path assembly 130A and second flow path assembly 130B are in contact with one another.

To efficiently package a plurality of flow path assemblies 130 within the vessel 160, the ratio of the outside diameter of the tube sections 185 to the outside diameter of the chamber assemblies 190 is selected to be within the range of 1:1.5 to 1:2.5. In a preferred embodiment of the invention, such ratio is selected to be 1:2 within the tolerance of manufacture. Thus, in the preferred embodiment, if the tube section 185 outside diameter is 5 mm, the chamber assembly 190 has an outside diameter of 10 mm. Similarly, if the tube section 185 outside diameter is 6 mm, the chamber assembly 190 has an outside diameter of 12 mm. In the most preferred embodiment of the invention, the 1:2 outside diameters ratio is utilized and the flow path assemblies 130 are arranged as shown in, and described with respect to, FIGS. 5A and 5B without the flow path assemblies 130 being in physical contact with each other. As the plurality of flow path assemblies 130 are staggeringly arranged within the vessel 160, the cooling medium is obstructed from flowing in a generally straight line within the vessel. The cooling medium that first comes into contact with the exterior of the lateral wall 200 of the chamber assembly 190 of a flow path assembly 130 is directed laterally along the external contour of the lateral wall 200 of the chamber assembly 190. As the plurality of flow path assembly 130 are staggeringly arranged within the vessel 160, the cooling medium directed laterally along the exterior contour of the plurality of lateral walls 200 of the chamber assemblies 190 then generally comes into contact with the tubular sections 185 of the adjacent flow path assembly 130. The process is repeated until the cooling medium reaches the output distribution plate 175. The output distribution plate 175 is positioned on the opposite plane from the input distribution plate 170 of the vessel 160. The output distribution plate 175 is provided with the plurality of output distribution plate orifices 177, permitting flow of the cooling medium from the vessel 160 to the outlet side cooling medium tank 180. The staggered arrangement of the tube sections 185 and the chamber sections 190 provides multiple interruptions to the flow of the cooling heat exchange medium flowing around the plurality of flow path assemblies 130, thereby enhancing the heat transfer effectiveness of the cooling heat exchange medium.

Figure 6A:
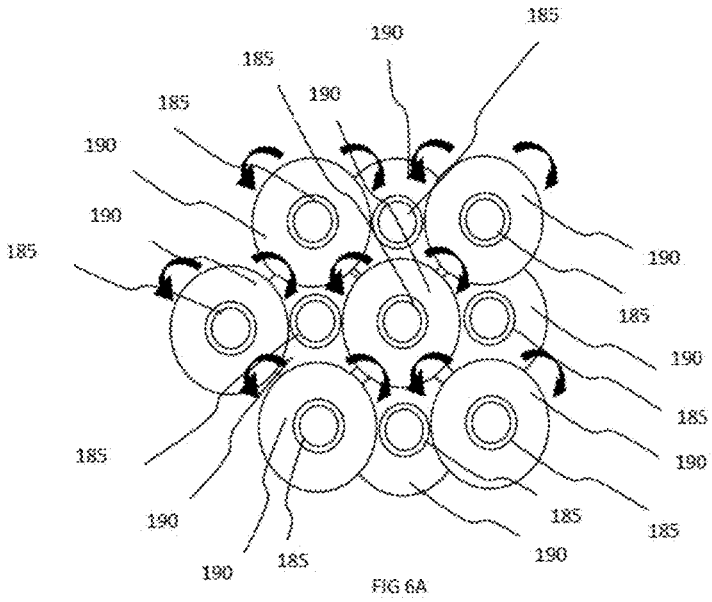
FIG. 6A is a schematic front view of flow path assemblies within the vessel according to an embodiment of the present invention.
Figure 6B:
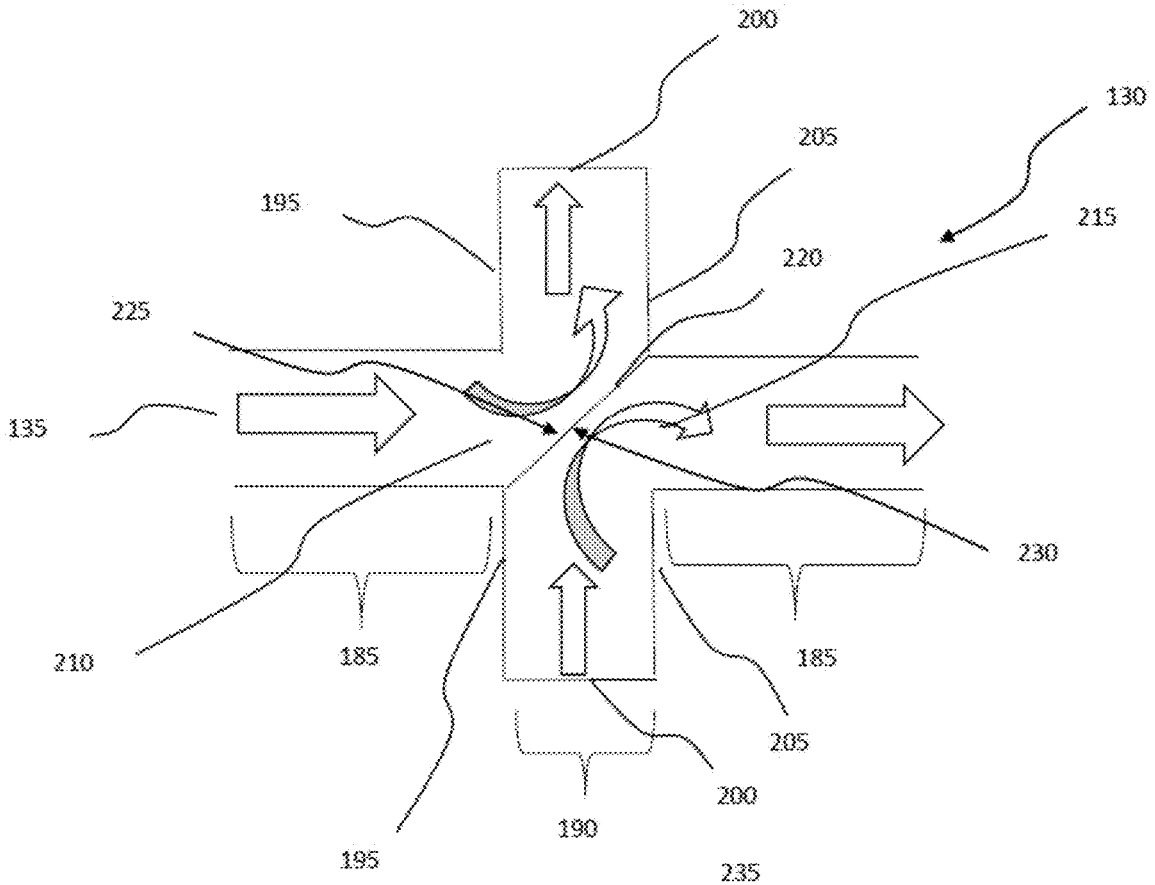
FIG. 6B is a schematic side view of a flow path assembly according to an embodiment of the present invention.
Figure 6C:
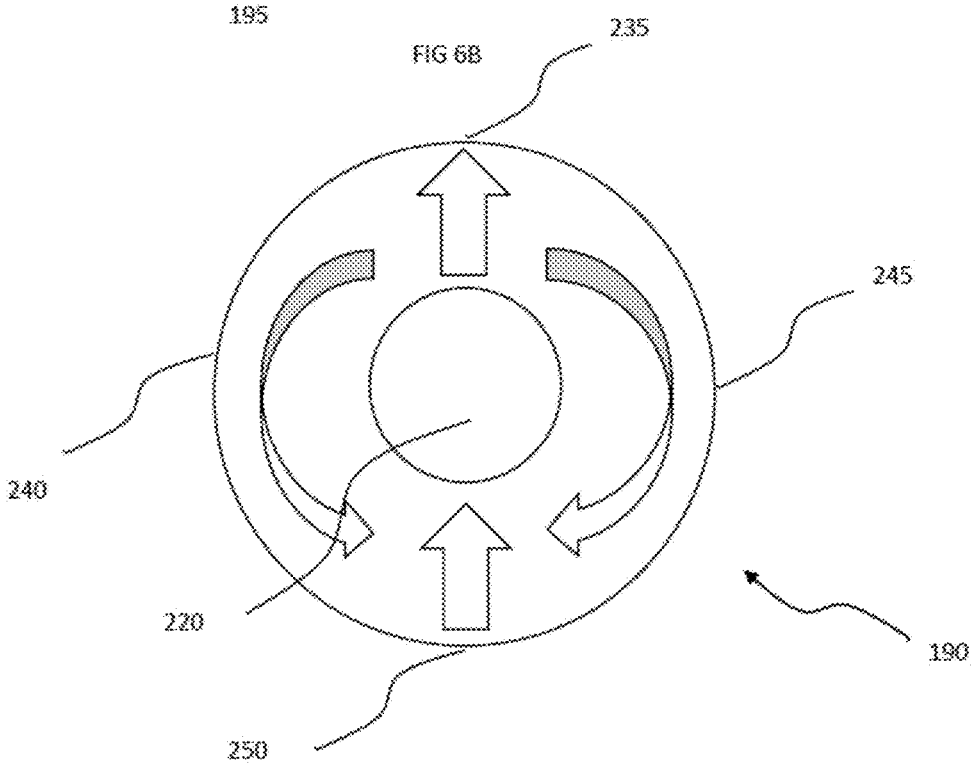
FIG. 6C is a schematic front view of a chamber assembly according to an embodiment of the present invention.

Referring now to FIGS. 6B and 6C schematic side and frontal views of a flow path assembly 130 are respectively shown. The flow path assembly 130 comprises the plurality of tube sections 185 and at least one chamber section 190. The chamber section 190 has the first planar wall 195, the second planar wall 205, and the lateral wall 200 concentrically connecting the outer circumference of the first planar wall 195 and the second planar wall 205. The first planar wall 195 and the second planar wall 205 are set apart at a predetermined distance to allow a gap between each other. The lateral wall 200 connects the outer circumference of the first planar wall and the second planar wall to form a watertight seal. The chamber section 190 is hollow, allowing flow of exhaust gas within. The flow path assembly 130 provides the flow path 135 to permit flow of the exhaust gas within.

Disposed within the chamber section 190 is a medium directing component 220. The medium directing component 220 is at least partially coupled to the planar wall 195 of the chamber section 190, extends laterally through the chamber section 190, and is at least partially coupled to the planar wall 205 of the chamber section 190. The planar wall 195 of the chamber section 190 is provided with an inlet orifice 210, allowing flow of exhaust gas into the chamber section 190. Coupled to the inlet orifice 210 of the chamber section 190 is a tube section 185, piping exhaust gas into the chamber section 190 from the exhaust gas inlet side tank 140 via an orifice 147 in the input header plate 145. The planar wall 205 of the chamber section 190 is provided with an outlet orifice 215, allowing discharge of exhaust gas out of the chamber section 190. Coupled to the outlet orifice 215 is a tube section 185. Multiple sets of chamber sections 190 and tube sections 185 may be interconnected to provide a flow path assembly 130 that terminates at an orifice 152 in the output header plate 150. As previously explained, multiple sets of flow path assemblies 130 may be disposed between the input header plate 145 and the output header plate 150.

The exhaust gas introduced into flow path 135 within the flow path assembly 130 first flows in an initial line of flow within the tube section 185. The tube section 185 is coupled to the chamber section 190. The tube section 185 is hollow, permitting flow of exhaust gas within. The chamber section 190 is provided with the inlet orifice 210, permitting flow of exhaust gas into the chamber section 190 from the tube section 185. As exhaust gas enters the chamber section 190 through the inlet orifice 210, exhaust gas comes into contact with the first side 225 of the medium directing component 220. The first side 225 of the medium directing component 220 facing the inlet orifice 210 is set at an angle to direct exhaust gas to a second line of flow, wherein the second line of flow is generally perpendicular to the initial line of flow. As exhaust gas is directed into the second line of flow, exhaust gas is directed into the interior of the chamber assembly 190. As exhaust gas enters the chamber section 190, exhaust gas is led towards a first end 235 of the chamber assembly 190 (see FIG. 6C). Once exhaust gas reaches the first end 235 of the chamber assembly 190, the flow of exhaust gas is diverted into two divergent flows, generally symmetrical to one another, in a semi-circular manner within the chamber assembly 190. In another embodiment of the present invention, as the exhaust gas reaches the first end 235 of the chamber assembly 190, the flow of exhaust gas is diverted into two divergent semi-circular flow paths within the chamber assembly 190, yet the two divergent flow paths are not symmetrical to one another. In the preferred embodiment of the present invention, the diameter of the chamber section 190 is substantially larger than the diameter of the tube section 185.

The two semi-circular flow patterns flow away from each other, while generally axially aligned to one another, following the contour of the interior of the chamber assembly 190. The first semi-circular flow follows the contour of the first lateral contour 240 of the interior chamber of the chamber assembly 190. The second semi-circular flow follows the contour of the second lateral contour 245 of the chamber assembly 190. After exhaust gas completes the semi-circular flow within the chamber assembly 190, flowing along the interior contour of the chamber assembly 190, the two semi-circular flows converge to form one single flow once again generally around a second end 250 of the chamber section of the chamber assembly 190. The second end 250 of the chamber section at which the two semi-circular flow paths converge is generally on the end opposite to the first end 235 of the chamber section.

As the two semi-circular exhaust gas flows converge into one main flow again at the second end 250 of the chamber assembly 190, exhaust gas is simultaneously directed in a new flow path, wherein the angle of an attack of the new flow path is substantially divergent from the lines of flow of the respective semi-circular flow paths. As the two semi-circular flows within the chamber assembly 190 converge at the second end 250 of the chamber assembly, the converged flow of exhaust gas is directed towards a second surface 230 of the medium directing component 220 (see FIG. 6B). The second surface 230 of the medium directing component 220 is set at an angle, generally diverting the flow of exhaust gas to nearly a perpendicular flow direction, axially aligned to the axis of a second tubular section 185. The second surface 230 of the medium directing component 220 is generally on the side opposite of the first surface 225 of the medium directing component 220. The second tubular section 185 is connected to the second planar wall 205 of the chamber assembly 190. The second planar wall 205 of the chamber assembly 190 is provided with an outlet orifice 215 to permit flow of exhaust gas from the interior of the chamber assembly 190 into the second tubular section 185. In another embodiment of the present invention, the two semi-circular flow patterns flow away from each other, following the contour of the interior of the chamber assembly 190, yet may not be axially aligned to one another.

The flow path assembly 130 may comprise of a plurality of tube section 185, chamber section 190, and medium directing component 220 assemblies. As such, the flow pattern as described herein may be repeated several times dependent upon the number of tubular sections 185, chamber sections 190, and medium directing components 220 contained within a particular flow path assembly 130. As the exhaust gas travels within the interior of a chamber assembly 190, as well as directly through the tube sections 185, the flow path 135 is substantially longer than the axial length of the tube sections 185 and chamber assembly 190 components. The heat exchange surface area provided by a flow path assembly 130 is therefore substantially greater than that provided by prior art designs in which exhaust gas flows through only round or rectangular tubes.

Further, in combination, the tube sections 185 and chamber assemblies provide a number of obstructions within the flow path 135 which causes the exhaust gas flow to be forcefully and repeatedly disrupted from continuing to flow in an establish flow. Such obstructions include the first surface 225 of the medium directing component 220, the first end 235 of the chamber assembly 190, the second end 250 of the chamber assembly 190 and the second surface 230 of the medium directing component 220. Each of these disruptions provides a plurality of mixing action and turbulence inducing flow patterns to the exhaust gas. The mixing action and turbulence inducing flow patterns serve to counter the natural tendency of the exhaust gas to establish a boundary layer along the surface of the flow path. Disrupting the establishment of such a boundary layer not only enhances heat transfer effectiveness, it also counters the tendency of contaminants, such as carbon or soot, to settle on the surface of the flow path.

In FIG. 6A and FIG. 6B, the tubular section 185 is illustrated as being hollow and circular. In other embodiments, the tubular structure 185 may be hollow but non-circular, such as an oval, rectangular shape, or other geometric shapes. In the illustrated embodiment, the chamber section 190 is hollow and circular in shape. In other embodiments, the chamber section 190 may be hollow, but non-circular in shape, such as an oval or rectangular shape, for example. Additionally, when a plurality of chamber sections 190 are combined together in a flow path assembly 130, a first chamber section 190 may be circular, whereas a second chamber section 190 is non-circular. Also, when a plurality of tube sections 185 are combined together in a flow path assembly 130, a first tube section 185 may be circular, whereas a second tube section 185 is non-circular.

The tubular section 185, chamber section 190, and the medium directing component 220 may be made of stainless steel. The tubular section 185, chamber section 190, and the medium directing component 220 may also be made of other ferrous or non-ferrous material, or other suitable material. The tubular section 185, chamber section 190, and the medium directing component 220 may be coupled together with brazing paste or without brazing paste. In other embodiment of the present invention, the tubular section 185, chamber section 190, and the medium directing component 220 may be coupled together with brazing material. Also, an embodiment of the present invention allows for the tubular section 185, the chamber section 190, and the medium directing component 220 to be made of materials different from each other. Additionally, a sealing material may be used to seal between various components utilized to form the heat exchanger 100.

The size of a chamber section 190 may vary from one chamber section to the next. The medium directing component 220 facilitates exhaust gas agitating and turbulence inducing flow, maximizing exhaust gas enhancing heat transfer effectiveness. The inner surface of the chamber section 190 may feature indentations to increase the surface area. The medium directing component 220 may also feature indentations. The indentations featured on the interior or the exterior of the chamber sections 190 may also be put in place to alter the flow pattern or the flow speed of exhaust gas flowing in the chamber section 190 or of the cooling medium flowing outside of the chamber sections 190. The chamber sections 190 may have other surface features such as, but not limited to, louvers or dimples, as well as other extended surface features to alter the fluid flow characteristics within or outside the chamber sections 190.

As schematically shown in FIG. 6B, a tube section 185 may terminate at the inlet orifice 210 of a chamber assembly 190. Alternatively, portions of a single tube may extend through the inlet and orifices of one or more chamber assemblies with the chamber interior being positioned over inlet and outlet orifices located on opposite sides of the tube. Further, a chamber assembly may include, in addition to the main chamber schematically shown in FIG. 6B, first and second sub-chambers respectively associated with the planar walls 195,205 and having lateral walls which fittingly engage with, and are bonded to, lateral walls of the medium directing components, as described in U.S. Pat. No. 9,151,547, the disclosure of which is incorporated herein by reference.

Figure 6D:
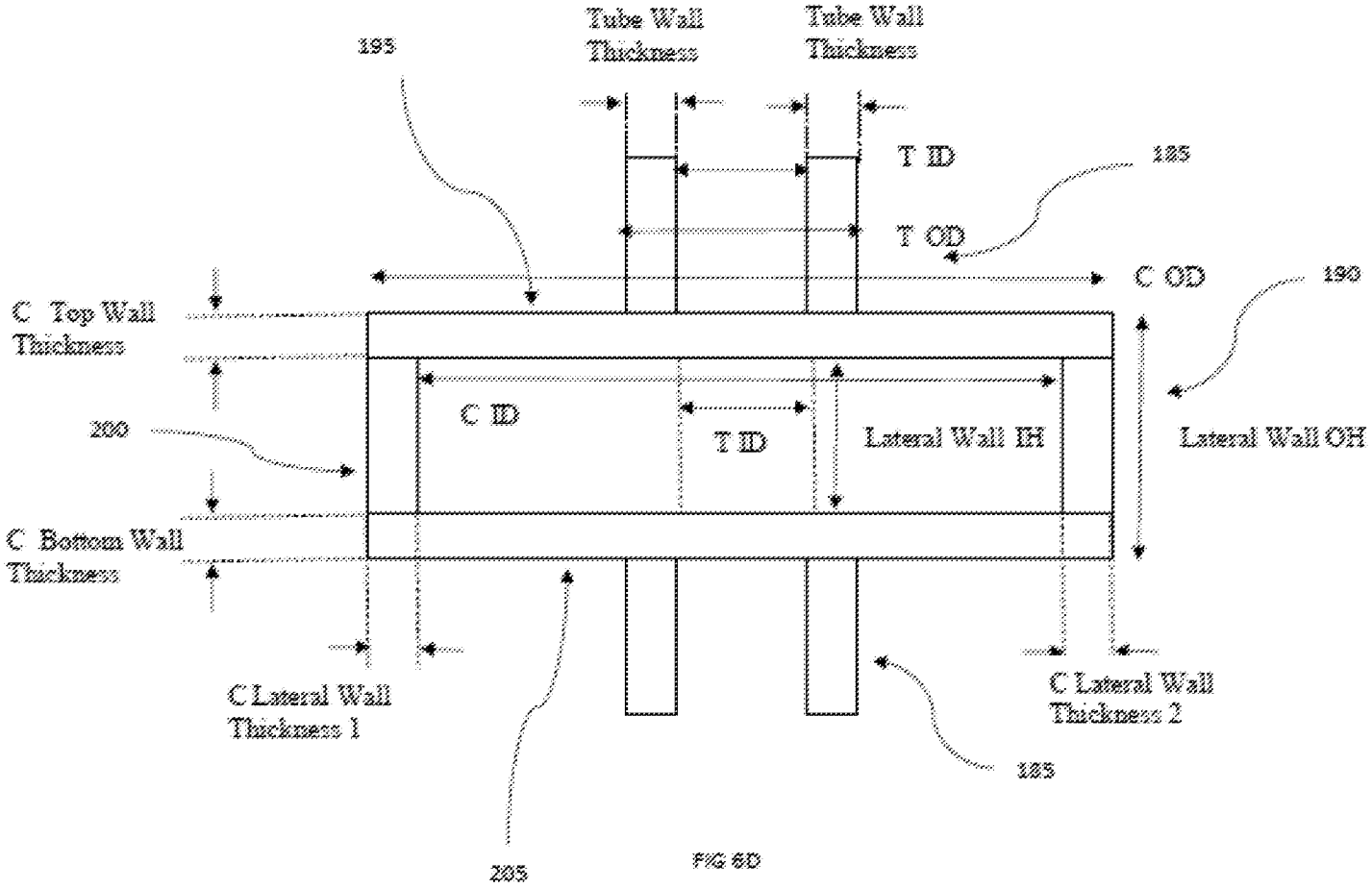
FIG. 6D is a schematic cross-sectional side view of a chamber assembly.

Referring now to FIG. 6D, as exhaust gas flows through the flow path 135, pressure drop due to friction factor as well as pressure drop due to exhaust gas directional changes within the flow path assembly 130 cannot be avoided. However, pressure drop due to flow path surface area constriction can be minimized as long as the baseline flow path surface area established by the tube section 185 is maintained throughout the chamber assembly 190 flow path. Therefore, in the preferred embodiment of the present invention, the dimensions of the tube section and the chamber assembly components are selected such that: tube section flow path surface area ($T_{FLOW\ SURFACE\ AREA}$)≤chamber assembly total flow path surface area ($C_{FLOW\ SURFACE\ AREA}$).

The baseline tube section flow path surface area, $T_{FLOW\ SURFACE\ AREA}$, for a tube having an inside diameter, $T_{ID}$, is equal to $\pi\times(T_{ID}/2)^2$. $T_{ID}$ is determined by subtracting the tube wall thickness from the tube outside diameter $T_{OD}$, thus $T_{ID}=T_{OD}-2\times(\text{Tube}_{Wall\ Thickness})$.

To determine the total chamber assembly flow path surface area, $C_{FLOW\ SURFACE\ AREA}$, the following calculation method is utilized. As the chamber assembly flow path is generally rectangular in shape, the surface area of the chamber flow path is determined by calculating for rectangular surface area by multiplying the flow path width, $F_{WIDTH}$, by the lateral wall inside height, Lateral $\text{Wall}_{IH}$: $C_{FLOW\ SURFACE\ AREA}=F_{WIDTH}\times\text{Lateral Wall}_{IH}$.

To determine $F_{WIDTH}$, the chamber inside diameter, $C_{ID}$, is first determined by subtracting the two lateral material thicknesses, $C_{LATERAL\ WALL\ THICKNESS\ 1}$ and $C_{LATERAL\ WALL\ THICKNESS\ 2}$, from the chamber outside diameter $C_{OD}$: $C_{ID}=C_{OD}-C_{LATERAL\ WALL\ THICKNESS\ 1}-C_{LATERAL\ WALL\ THICKNESS\ 2}$.

To complete the calculation of the flow path width, $F_{WIDTH}$, within the chamber assembly 190, the tube inside diameter, $T_{ID}$, is subtracted from $C_{ID}$: $F_{WIDTH}=C_{ID}-T_{ID}$.

To determine Lateral $\text{Wall}_{IH}$, the top and the bottom chamber wall thickness, $C_{TOP\ WALL\ THICKNESS}$ and $C_{BOTTOM\ WALL\ THICKNESS}$, are subtracted from the external lateral wall 200 height, Lateral $\text{Wall}_{OH}$: Lateral $\text{Wall}_{IH}$=Lateral $\text{Wall}_{OH}-C_{TOP\ WALL\ THICKNESS}-C_{BOTTOM\ WALL\ THICKNESS}$.

For example, if the $T_{OD}$ is 6 mm and the $\text{Tube}_{Wall\ Thickness}$ is 0.3 mm, then the $T_{ID}$ would be 5.4 mm. The $C_{FLOW\ SURFACE\ AREA}$ would then be equal to $\pi\times(5.4/2)^2$ or 22.89 $mm^2$. Establishing the $T_{OD}$ to $C_{OD}$ relationship as 1:2, then the $C_{OD}$ would be 12 mm. Setting the $C_{LATERAL\ WALL\ THICKNESS\ 1}$ and $C_{LATERAL\ WALL\ THICKNESS\ 2}$ at 0.3 mm, then the $C_{ID}$ would be 11.4 mm. $F_{WIDTH}$ would therefore be 6 mm. If $C_{TOP\ WALL\ THICKNESS}$ and $C_{BOTTOM\ WALL\ THICKNESS}$ are both 0.3 mm, then as long as Lateral $Wall_{OH}$ is equal to or greater than 4.415 mm, then it meets the criteria, $T_{FLOW\ SURFACE\ AREA} \leq C_{FLOW\ SURFACE\ AREA}$ minimizing pressure drop due to the constriction of flow path surface area in the flow path assembly 130.

Figure 8A:
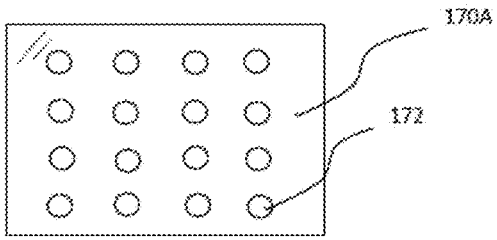
FIGS. 8A-8G are top views of distribution plates according to various embodiments of the present invention.

Referring to FIGS. 8A-8G, different embodiments of a distribution plate 170 are shown. Referring now to FIG. 8A, an embodiment of a distribution plate 170 is shown. The distribution plate 170A is generally planar, provided with a plurality of input distribution plate orifices 172. The input distribution plate orifices 172 extend from one side of the distribution plate 170A and extend to the opposing side of the distribution plate 170A, permitting flow of the cooling medium through the distribution plate 170A. The input distribution plate orifices 172 may be uniform in size, and arranged along the distribution plate 170A with equal spacing.

Figure 8D:
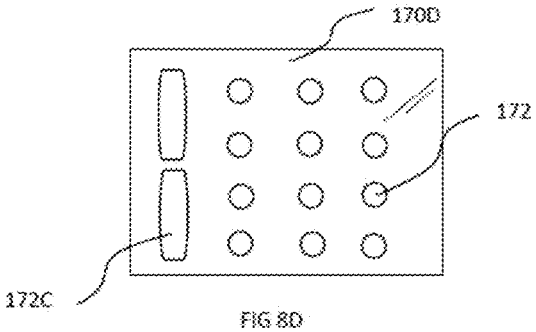
Figure 8B:
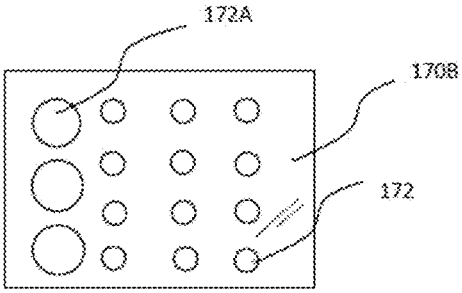

Now referring to FIG. 8B, another embodiment of a distribution plate 170 is shown. A distribution plate 170B is generally planar, provided with a plurality of input distribution plate orifices 172 and input distribution plate orifices 172A. Input distribution plate orifices 172 and input distribution plate orifices 172A extend from one side of the distribution plate 170B and extend to the opposing side of the distribution plate 170B, permitting flow of the cooling medium through the distribution plate 170B. The input distribution plate orifices 172 and the input distribution plate orifices 172A are of varying size and geometric shape. In an embodiment of the present invention, the larger input distribution plate orifices 172A may be placed over an area of the vessel 160 where it may be desired to distribute more cooling medium, as larger diameter input distribution plate orifices 172A may direct more cooling medium to the particular area of the vessel 160.

Figure 8E:
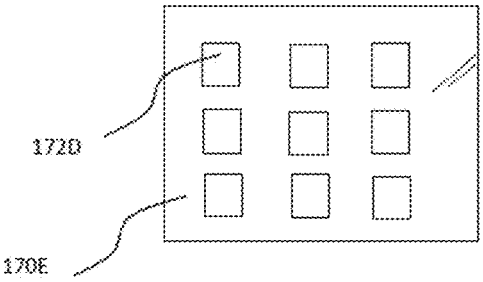
Figure 8C:
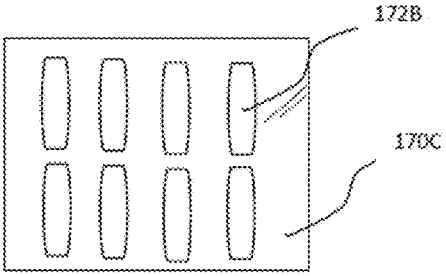

Now referring to FIG. 8C, an embodiment of a distribution plate 170 is shown. A distribution plate 170C is generally planar, provided with a plurality of input distribution plate orifices 172B. The input distribution plate orifices 172B extend from one side of the distribution plate 170C to the opposing side of the distribution plate 170C, permitting flow of the cooling medium through the distribution plate 170C. Input distribution plate orifices 172B may be uniform in size, and arranged along the distribution plate 170C with equal spacing. Input distribution plate orifices 172B may have an oval shape, instead of a round shape, to provide a desired cooling medium distribution pattern within the vessel 160.

Referring to FIG. 8D, another embodiment of a distribution plate 170 is shown. A distribution plate 170D is generally planar, provided with a plurality of input distribution plate orifices 172 and input distribution plate orifices 172C. Input distribution plate orifices 172 and input distribution plate orifices 172C extend from one side of the distribution plate 170D to the opposing side of the distribution plate 170D, permitting flow of the cooling medium through the distribution plate 170. Input distribution plate orifices 172 and input distribution plate orifices 172C are of varying size and shape. Input distribution plate orifices 172 are generally round. Input distribution plate orifices 172C are generally of an oval shape. In an embodiment of the present invention, the larger input distribution plate orifices 172C may be placed over area of the vessel 160 to direct more cooling medium to the particular area of the vessel 160. Input distribution plate orifices 172 may be uniform in size and arranged along the distribution plate 170D with equal spacing.

Now referring to FIG. 8E a distribution plate 170E is generally planar, provided with a plurality of input distribution plate orifices 172D. Input distribution plate orifices 172D extend from one side of the distribution plate 170 to the opposing side of the distribution plate 170E, permitting flow of the cooling medium through the distribution plate 170E. Input distribution plate orifices 172D may be uniform in size, and arranged along the distribution plate 170E with equal spacing.

Figure 8F:
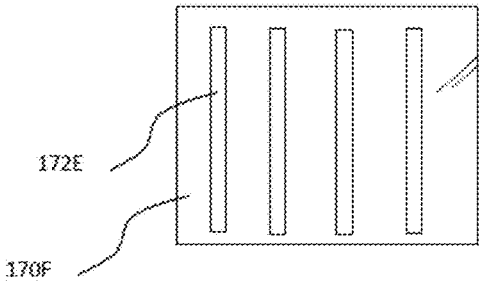

Now referring to FIG. 8F a distribution plate 170F is generally planar, provided with a plurality of input distribution plate orifices 172E. Input distribution plate orifices 172E extend from one side of the distribution plate 170F to the opposing side of the distribution plate 170F, permitting flow of cooling medium through the distribution plate 170F. Input distribution plate orifices 172E may be uniform in size, and arranged along the distribution plate 170F with equal spacing. Input distribution plate orifices 172E may be populated from one end of the distribution plate 170F to the opposing end of the distribution plate 170F. Input distribution plate orifices 172E may be of rectangular shape or other geometric shapes, such as an oval, for example.

Figure 8G:
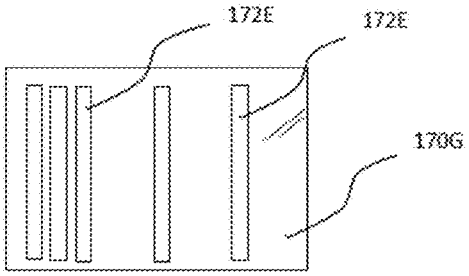

Referring now to FIG. 8G, another embodiment of a distribution plate 170 is shown. A distribution plate 170G is generally planar, provided with a plurality of input distribution plate orifices 172E. Input distribution plate orifices 172E extend from one side of the distribution plate 170G to the opposing side of the distribution plate 170G, and permit flow of the cooling medium through the distribution plate 170G. The input distribution plate orifices 172E may be uniform in size and arranged along the distribution plate 170G with equal spacing. The input distribution plate orifices 172E may be populated from one end of the distribution plate 170G to the opposing end of the distribution plate 170G. The input distribution plate orifices 172E may be of rectangular shapes or other geometric shapes, such as an oval, for example. The input distribution plate orifices 172E may be concentrated over a particular area of the vessel 160 to provide more cooling medium to that specific area of the vessel 160. The input distribution plate orifices 172E may also be sparsely populated over a specific section of the distribution plate 170G to restrict flow of the cooling medium over that particular section of the vessel 160.

The configuration and arrangement of a plurality of output distribution plate orifices 177 provided on the output distribution plate 175 may be identical to the configuration of the input distribution plate orifices 172 on the input distribution plate 170. In another embodiment of the present invention, the output distribution plate orifices 177 on the outlet distribution plate 175 may not mirror the configuration of the input distribution plate orifices 172 on the input distribution plate 170.

In yet another embodiment of the present invention, the input distribution plate 170 may not be utilized where cooling medium introduced into the cooling medium inlet side tank 165 is directly fed to the exterior surfaces of the flow path assemblies 130 contained within the heat exchanger 100. In yet another embodiment of the present invention, the input distribution plate 170 may be utilized while the outlet distribution plate 175 is not utilized. In such an embodiment, the cooling medium is directed straight to the cooling medium output side tank 180 once it completes its flow around the flow path assemblies 130 contained within the heat exchanger 100.

Many modifications and variations of the present invention are possible in light of the above teachings. Therefore, within the scope of the appended claims, the present invention may be practiced other than as specifically described. For example, the present invention described herein assumes application of the heat exchanger 100 as an EGR cooler. However, the heat exchanger may be utilized in other applications. Therefore, the heat exchange medium flowing inside the plurality of flow path assemblies 130 of the heat exchanger 100 may be something other than exhaust gas, for example. Similarly, the heat exchange medium flowing outside the plurality of flow path assemblies 130 of the heat exchanger 100 may be some other medium than cooling fluid piped in from the cooling loop of an internal combustion engine.

What is claimed:

1. A heat exchanger for exchanging heat between a first heat exchange medium and a second heat exchange medium, the heat exchanger comprising:

a parrallelpiped body having a first pair of parallel faces realized by an input header plate and an output header plate, a second pair of parallel faces realized by an input distribution plate and an output distribution plate, and a third pair of parallel faces realized by a first case body lateral panel and a second case body lateral panel, each of the input and output header plates having a plurality of orifices, each input header plate orifice corresponding to one of the output header plate orifices, and each of the input and output distribution plates having a plurality of orifices;

a flow path assembly extending between each input header plate orifice and the corresponding output header plate orifice, the flow path assembly including at least one chamber assembly, each of which is disposed between a first tubular segment and a second tubular segment, each flow path assembly having one more tubular segment than chamber assemblies, each said at least one chamber assembly having a medium directing component disposed within, and first and second planar walls to at least partially define a chamber interior, the first planar chamber wall having an inlet orifice to provide fluid communication between the first tubular segment and the chamber interior, and the second planar chamber wall having an outlet orifice to provide fluid communication between the second tubular segment and the chamber interior, and the medium directing component including a plate having a first side which has an angled surface with respect to the longitudinal axis of the first tubular segment and facing the inlet orifice and the chamber interior, and a second side which has an angled surface with respect to the longitudinal axis of the second tubular segment and facing the outlet orifice and the chamber interior, said medium directing component being at least partially coupled to said first and second planar chamber walls;

a first medium inlet side tank engaged with the input header plate to provide fluid communication between a first medium inlet and each input header plate orifice;

a first medium outlet side tank engaged with the output header plate to provide fluid communication between each output header plate orifice and a first medium outlet;

a second medium inlet side tank engaged with the input distribution plate to provide fluid communication between a second medium inlet and each input distribution plate orifice; and a second medium outlet side tank engaged with the output distribution plate to provide fluid communication between each output distribution plate orifice and a second medium outlet.

2. The heat exchanger of claim 1, wherein said at least one chamber assembly defines a chamber assembly flow path, the first tubular segment defines a first tubular segment flow path, and the second tubular segment defines a second tubular segment flow path, wherein a surface area of the chamber assembly flow path is equal to or greater than the surface area of each of the first tubular segment flow path and the second tubular segment flow path.

3. The heat exchanger of claim 1, wherein the at least one chamber assembly in the flow path assembly has an outside diameter which is in the range of 1.5 to 2.5 times the outside diameter of the tubular segments within the same flow path assembly.

4. The heat exchanger of claim 3, wherein the outside diameter of the chamber assembly is equal to twice the outside diameter of the tubular segments.

5. The heat exchanger of claim 1, wherein each of said flow path assemblies includes a respective plurality of said chamber assemblies, and wherein a portion of one of the chamber assemblies in a first one of the flow path assemblies is positioned adjacent to a respective tubular segment of a second one of the flow path assemblies, and is interposed between adjacent chamber assemblies of the second flow path assembly.

6. The heat exchanger of claim 1, wherein each of the input header plate orifices is axially aligned with the corresponding output header plate orifice.

7. The heat exchanger of claim 1, each input distribution plate orifice corresponding to one of the output distribution plate orifices.

8. The heat exchanger of claim 7, wherein each of the input distribution plate orifices is axially aligned with the corresponding output distribution plate orifice.

* * * * *